US011384746B2

(12) United States Patent
St. George

(10) Patent No.: US 11,384,746 B2
(45) Date of Patent: Jul. 12, 2022

(54) CENTRALLY LOCATED LINEAR ACTUATORS FOR DRIVING DISPLACERS IN A THERMODYNAMIC APPARATUS

(71) Applicant: ThermoLift, Inc., Stony Brook, NY (US)

(72) Inventor: Theodore St. George, Anchorage, AK (US)

(73) Assignee: ThermoLift, Inc., Stony Brook, NY (US)

( * ) Notice: Subject to any disclaimer, the term of this patent is extended or adjusted under 35 U.S.C. 154(b) by 331 days.

(21) Appl. No.: 16/650,308

(22) PCT Filed: Sep. 25, 2018

(86) PCT No.: PCT/US2018/052644

§ 371 (c)(1),
(2) Date: Mar. 24, 2020

(87) PCT Pub. No.: WO2019/060890

PCT Pub. Date: Mar. 28, 2019

(65) Prior Publication Data

US 2020/0277944 A1 Sep. 3, 2020

Related U.S. Application Data

(60) Provisional application No. 62/562,569, filed on Sep. 25, 2017.

(51) Int. Cl.

| | |
|---|---|
| ***F04B 17/04*** | (2006.01) |
| ***F25B 9/14*** | (2006.01) |
| ***F25B 30/02*** | (2006.01) |

(52) U.S. Cl.

CPC ..... *F04B 17/04* (2013.01); *F25B 9/14* (2013.01); *F25B 30/02* (2013.01); *F25B 2400/073* (2013.01)

(58) Field of Classification Search

CPC .. F04B 17/04; F25B 9/14; F25B 30/02; F25B 2400/073; F02G 1/0445

See application file for complete search history.

(56) References Cited

U.S. PATENT DOCUMENTS

| | | | | |
|---|---|---|---|---|
| 1,275,507 A | | 8/1918 | Vuilleumier | |
| 4,683,723 A | * | 8/1987 | Doi | F02G 1/0435 60/520 |
| 5,461,869 A | * | 10/1995 | Ishino | F02G 1/0445 60/520 |

(Continued)

FOREIGN PATENT DOCUMENTS

WO 2017070241 A1 4/2017

*Primary Examiner* — Emmanuel E Duke
(74) *Attorney, Agent, or Firm* — Diana D. Brehob; Brehob Law, PLLC

(57) ABSTRACT

A heat pump is disclosed that has a hot displacer section and a cold displacer section with a linear actuator section disposed between the hot and cold displacer sections. By providing the linear actuator section between the displacers, the shafts that couple the actuators in the linear actuator section to their respective displacer is shorter than if the linear actuator section were located at the bottom of the cold displacer. The shorter shaft can be less stiff to avoid buckling. Due to a lesser propensity to cock, there is less friction of the shaft when reciprocating.

20 Claims, 3 Drawing Sheets

(56) References Cited

U.S. PATENT DOCUMENTS

| | | | | |
|---|---|---|---|---|
| 5,715,683 | A * | 2/1998 | Hofbauer | F02G 1/057 60/520 |
| 5,794,444 | A * | 8/1998 | Hofbauer | F02G 1/057 60/517 |
| 9,303,699 | B2 | 4/2016 | Kimes et al. | |
| 2004/0020199 | A1 | 2/2004 | Yamamoto | |
| 2004/0237562 | A1 | 12/2004 | Solomon | |
| 2014/0283511 | A1 | 9/2014 | Wood | |
| 2015/0075209 | A1 * | 3/2015 | Hofbauer | F25B 9/14 62/467 |
| 2015/0211440 | A1 | 7/2015 | Boostheat | |

* cited by examiner

CENTRALLY LOCATED LINEAR ACTUATORS FOR DRIVING DISPLACERS IN A THERMODYNAMIC APPARATUS

FIELD OF INVENTION

The present disclosure relates to placement of a linear actuation system for displacers within a heat pump.

BACKGROUND

Vuilleumier heat pumps have been known since the early $20^{th}$ century. Such heat pumps, as disclosed in U.S. Pat. No. 1,275,507, have two displacers that separate the internal volume into hot, warm, and cold chambers. The displacers are crank driven with a 90 degree offset. In a more recent development, the displacers in the heat pump are driven by a mechatronic system, as described in commonly-assigned U.S. Pat. No. 9,677,794. In FIG. 1, based on a figure from the '794 reference, a heat pump 100 has a hot displacer 102 that reciprocates within a hot displacer cylinder 107 and a cold displacer 104 that reciprocates within a cold displacer cylinder 106. The hot and cold displacer cylinder 107 and 106 are share a centerline 108. Displacers 102 and 104 are controlled by mechatronic actuators, the linear actuator portion of the mechatronic actuators being disposed in the lower half of the heat pump 100. A hot displacer actuator 110 and a cold displacer actuator 120 are coupled to the hot and cold displacers 102 and 104, respectively. Each of actuators 110 and 120 have a ferromagnetic bucket, 116 and 126, respectively. Ferromagnetic buckets 116 and 126 act as armatures. Armature 116 has a plate portion that extends outwardly from a cylindrical portion through which a spring 124 passes and to which a spring 114 is coupled. Spring 114 is associated with hot displacer 102; and spring 124 is associated with cold displacer 104. Armature 126 has a plate portion and a cylindrical portion to which springs 114 and 124 are coupled. Springs 114 and 124 are, in this example, springs that go between compression and tension as the displacer to which it is coupled moves between ends of travel.

Actuator 110 has coils 112 and 118 on either side of armature 116. When coil 112 is activated, armature 116 is attracted toward coil 112. When coil 112 is deactivated spring 114 causes armature 116 (and displacer 102) to move downward. If coil 118 is then activated, it attracts armature 116 toward coil 118. By deactivating coil 118, spring 114 causes armature 116 to move toward coil 112. By acting on armature 116 coupled to displacer 102, displacer 102 is caused to reciprocate between two ends of travel within cylinder 106. Similarly, displacer 104 is caused to reciprocate between its two ends of travel by judicious actuation of coils 122 and 128 that are disposed on either side of armature 126. Springs 114 and 126 are provided to exert force on displacers 102 and 104, respectively, to effect movement of the displacer between ends of travel. Particularly when the displacer is at the middle portion of travel, the coils acting on the armature associated with the displacer are much less effective than when the displacer is nearer ends of travel. The current draw for the armature to the coils at the middle of the stroke is high, thereby increasing the size of the coils, increasing the electrical energy losses, and possible overheating of the coils. The springs provide much of the force to move the displacers and the coils are used to control the last part of the travel and to cause the displacer to dwell at the end of travel for a desired duration.

In heat pump 100, displacers 102 and 104 separate the volume within cylinders 106 and 107 into four volumes: a hot volume 140, a hot-warm volume 142, a cold-warm volume 144, and a cold volume 146. A bridge 150 separates hot-warm volume 142 from cold-warm volume 144.

In addition to spring 114 that acts on hot displacer 102 and spring 114 that acts on cold displacer 104, it has been found to be advantageous to provide a gas spring that acts between displacers 102 and 104. A portion of the gas spring is volume 138 that is disposed with cold displacer 104. In addition, the gas spring can include volume within hot displacer 102 and cold displacer 104. Bridge 150 has a plunger 151 that causes volume 138 to be almost zero when cold displacer 104 is at its upper end of travel. Cold displacer 104 is shown at a middle position in FIG. 1, in which volume 138 is at an intermediate volume. By selecting the cross-sectional areas of plunger 151 and the shafts and selecting the total volume of the gas spring, the pressure in the gas spring can assist movement of displacers 102 and 104.

In heat pump 100, displacers 102 and 104 separate the volume within cylinders 106 and 107 into four volumes: a hot volume 140, a hot-warm volume 142, a cold-warm volume 144, and a cold volume 146. A bridge 150 separates hot-warm volume 142 from cold-warm volume 144.

Hot displacer 102 is coupled to shaft 130 that is coupled to shaft 134 via a coupler 132. Shaft 134 couples to armature 126. Movement of armature 126 moves hot displacer 102. Cold displacer 104 is coupled to armature 116 via hollow shaft 136.

Some less than desirable features are inherent in the actuation system represented in FIG. 1. By having shaft 134 move within hollow shaft 136, i.e., concentric shafts, leads to undesirable friction. Because shaft 134 is very long, it must be of a certain diameter and strength to prevent buckling. The critical buckling load is proportional to the inverse of the square of the length. Thus, the longer the length of the shaft, the greater the challenge to avoid buckling. In addition to buckling concerns, preserving concentricity and avoiding cocking of hot displacer 102 within cylinder 106 are complicated by longer shafts. Another concern is the number of gas seals to largely prevent gas flows between shafts 134 and 136 and at bridge 150, etc. Such seals lead to additional friction.

SUMMARY

To overcome at least one problem in the prior art, the linear actuator is disposed between the displacers. A thermodynamic apparatus is disclosed that has a hot displacer disposed in a hot displacer cylinder and a cold displacer disposed in a cold displacer cylinder. A central axis of the cold displacer cylinder collinear with a central axis of the hot displacer cylinder. A linear actuator section is disposed between the hot and cold displacer cylinders. the linear actuator section comprising a hot displacer linear actuator and a cold displacer linear actuator.

The hot displacer linear actuator includes: a first coil disposed within the linear actuator section at a first axial location within the linear actuator section, a second coil disposed within the linear actuator section at a second axial location within the linear actuator section, and a hot displacer armature disposed between the first coil and the second coil.

A hot displacer actuator of the thermodynamic apparatus includes: the hot displacer linear actuator, a shaft coupled between the armature of the hot displacer linear actuator and the hot displacer, and at least one spring disposed between the displacer and the linear actuator.

The cold displacer linear actuator has a third coil disposed within the linear actuator section at a third axial location within the linear actuator section, a fourth coil disposed within the linear actuator section at a fourth axial location within the linear actuator section, and a cold displacer armature disposed between the third coil and the fourth coil. The thermodynamic apparatus includes a cold displacer shaft coupled between the cold displacer armature and the cold displacer, a hot displacer shaft coupled between the hot displacer armature and the hot displacer.

In some embodiments, the spring is a tension-compression spring that is coupled to the displacer at a first end and coupled to a stationary element of the thermodynamic apparatus at a second end. The linear actuator section has a first end plate and a second end plate; and the stationary member is the first end plate. In other embodiments, the at least one spring is a pair of compression springs disposed in the heat pump with a first of the compression springs biased to exert an upward force on the hot displacer and a second of the springs biased to exert a downward force on the hot displacer.

A cold displacer actuator to move the cold displacer includes: a cold displacer shaft coupled between the cold displacer linear actuator and the cold displacer, a first coil disposed within the linear actuator section at a first axial location within the linear actuator section, a second coil disposed within the linear actuator section at a second axial location within the linear actuator section, a cold displacer armature coupled to the cold displacer shaft, the cold displacer armature disposed between the first coil and the second coil, a spring having a first end coupled to the cold displacer and a second end coupled to a stationary member of the thermodynamic apparatus.

The linear actuator section has a first end plate proximate the cold displacer cylinder and a second end plate proximate the hot displacer cylinder. The thermodynamic apparatus also has: a hot displacer shaft coupled to the hot displacer linear actuator, a cold displacer shaft coupled to the cold displacer linear actuator, a first orifice defined in the first end plate with a first a seal disposed in the first orifice, and a second orifice defined in the second end plate with a second seal disposed in the second orifice. The hot displacer shaft passes through the first seal and the cold displacer shaft passes through the second seal.

A passage through the cold shaft fluidly couples a volume within the cold displacer with a volume within the linear actuator section.

The hot displacer shaft has a diameter smaller than a diameter of the cold displacer shaft.

The thermodynamic apparatus includes: a power electronics module electrically coupled to the first, second, third, and fourth coils and an electronic control unit coupled to the power electronics module.

The thermodynamic apparatus includes: a gas spring disposed between the hot and cold displacer, the gas spring being partially comprised of gas-filled volume within the linear actuator section and volume within the cold displacer.

Also disclosed is a heat pump with a hot displacer disposed in a hot displacer cylinder, a cold displacer disposed in a cold displacer cylinder, a first linear actuator coupled to a shaft of the hot displacer, and a second linear actuator coupled to a shaft of the cold displacer. The first linear actuator is adjacent to the second linear actuator. The shaft of the cold displacer extends outwardly from the first linear actuator in a first direction. The shaft of the hot displacer extends outwardly from the second linear actuator in a second direction. The first direction is opposed to the second direction.

The hot displacer is disposed proximate a first end of the heat pump. The cold displacer is disposed proximate a second end of the heat pump. The first and second linear actuators are disposed in a linear actuator section. The linear actuator section is disposed between the hot and cold displacers.

Each of the first and second linear actuators has: first and second coils displaced along a central axis of the hot displacer cylinder from each other and disposed within the linear actuator section and an armature. The armature has one of a permanent magnet and a ferromagnetic material.

The armature of the first linear actuator is coupled to the shaft of the hot displacer and the armature of the second linear actuator is coupled to the shaft of the cold displacer.

The heat pump also includes: a power electronics module electrically coupled to the first and second coils of each of the first and second linear actuators, a first position sensor proximate one of: the hot displacer; the shaft associated with the hot displacer, and the armature associated with the hot displacer, and a second position sensor proximate one of: the cold displacer; the shaft associated with the cold displacer, and the armature associated with the cold displacer. The heat pump further includes an electronics control unit electronically coupled to the first and second position sensors and to the power electronics module.

The heat pump includes a gas spring coupled between the hot displacer and the cold displacer. A portion of the volume comprising the gas spring is disposed within the linear actuator section.

The shaft coupled to the hot displacer has a smaller diameter than the shaft coupled to the cold displacer. When the displacers move, the shafts reciprocate within orifices defined in end plates of the linear actuator section.

Also disclosed is heat pump having hot displacer disposed in a hot displacer cylinder, a cold displacer disposed in a cold displacer cylinder, with a central axis of the cold displacer cylinder collinear with a central axis of the hot displacer cylinder. The heat pump has a hot displacer actuator coupled to the hot displacer, the hot displacer actuator including a hot displacer linear actuator and a hot displacer spring. The heat pump also has a cold displacer actuator coupled to the cold displacer, the cold displacer actuator having a cold displacer linear actuator and a cold displacer spring. The hot displacer and cold displacer linear actuators are disposed in a linear actuator section. The linear actuator section is located between the hot and cold displacer cylinders.

The linear actuator section is delimited by a cylinder, a first end plate and a second end plate. The first and second end plates each have an orifice defined therein The heat pump also includes: a first seal disposed in the orifice of the first end plate, a second seal disposed in the orifice of the second end plate, a hot displacer shaft coupled between the hot displacer and the hot displacer linear actuator, the hot displacer shaft passing through the first seal, and a cold displacer shaft coupled between the cold displacer and the cold displacer linear actuator, the cold displacer shaft passing through the second seal.

Advantages of disclosed embodiments include at least:

- less bending of the shaft;
- elimination of friction of the shafts reciprocating one inside the other;
- easier assembly;

ability to remove the hot end from the cold end for repair purpose without complete disassembly of both ends;

reduced conduction between the hot end and the cold end improvement of alignment of the shafts and the displacers;

reduction in the number of seals (reduced part count; better overall sealing; easier assembly; fewer failure opportunities; and lower friction); and use of the mechatronics volume as a gas spring.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
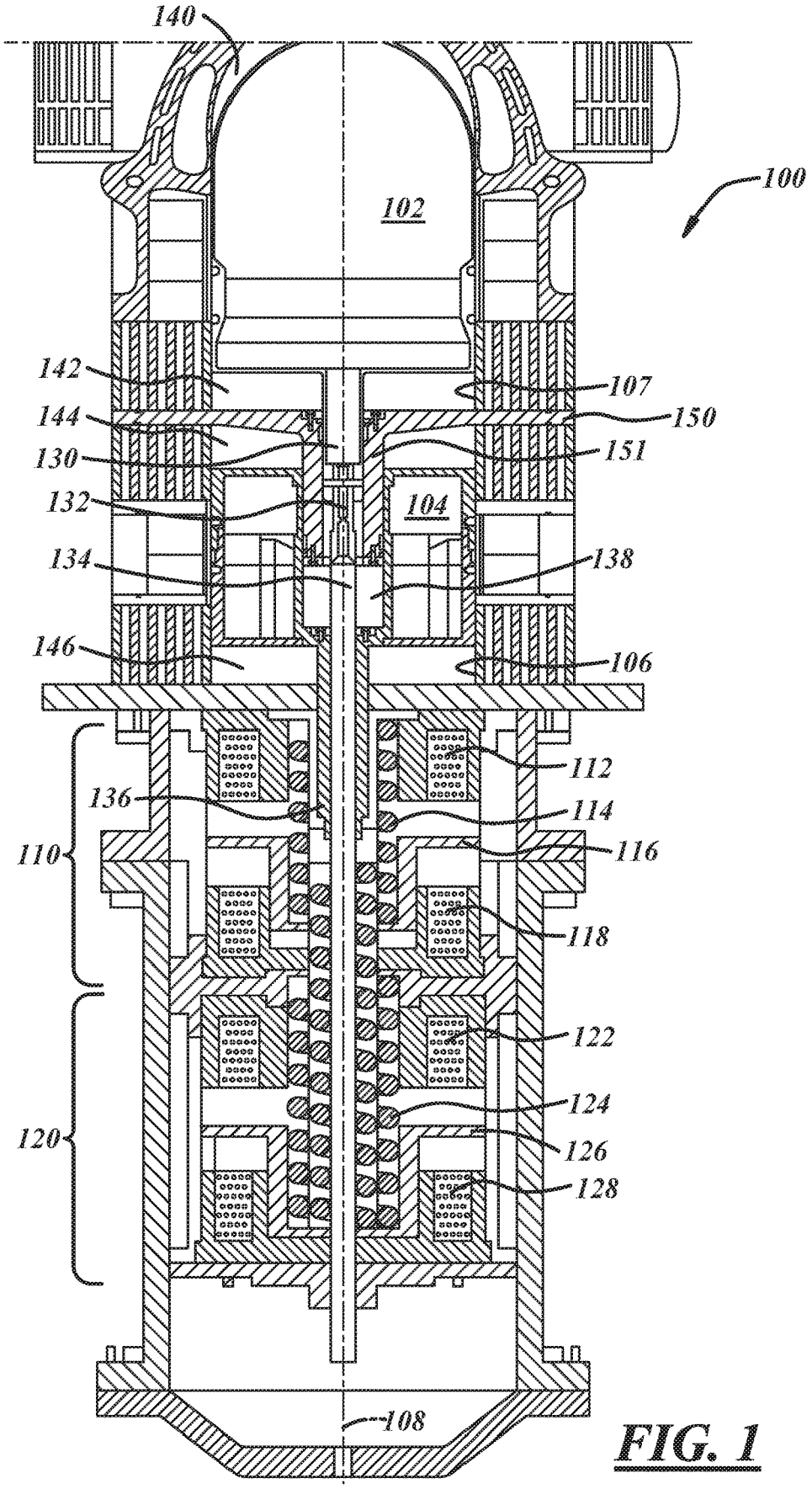
FIG. 1 is a schematic of a linear actuation system for a gas-fired heat pump with the linear actuators at one end of the heat pump.
Figure 2:
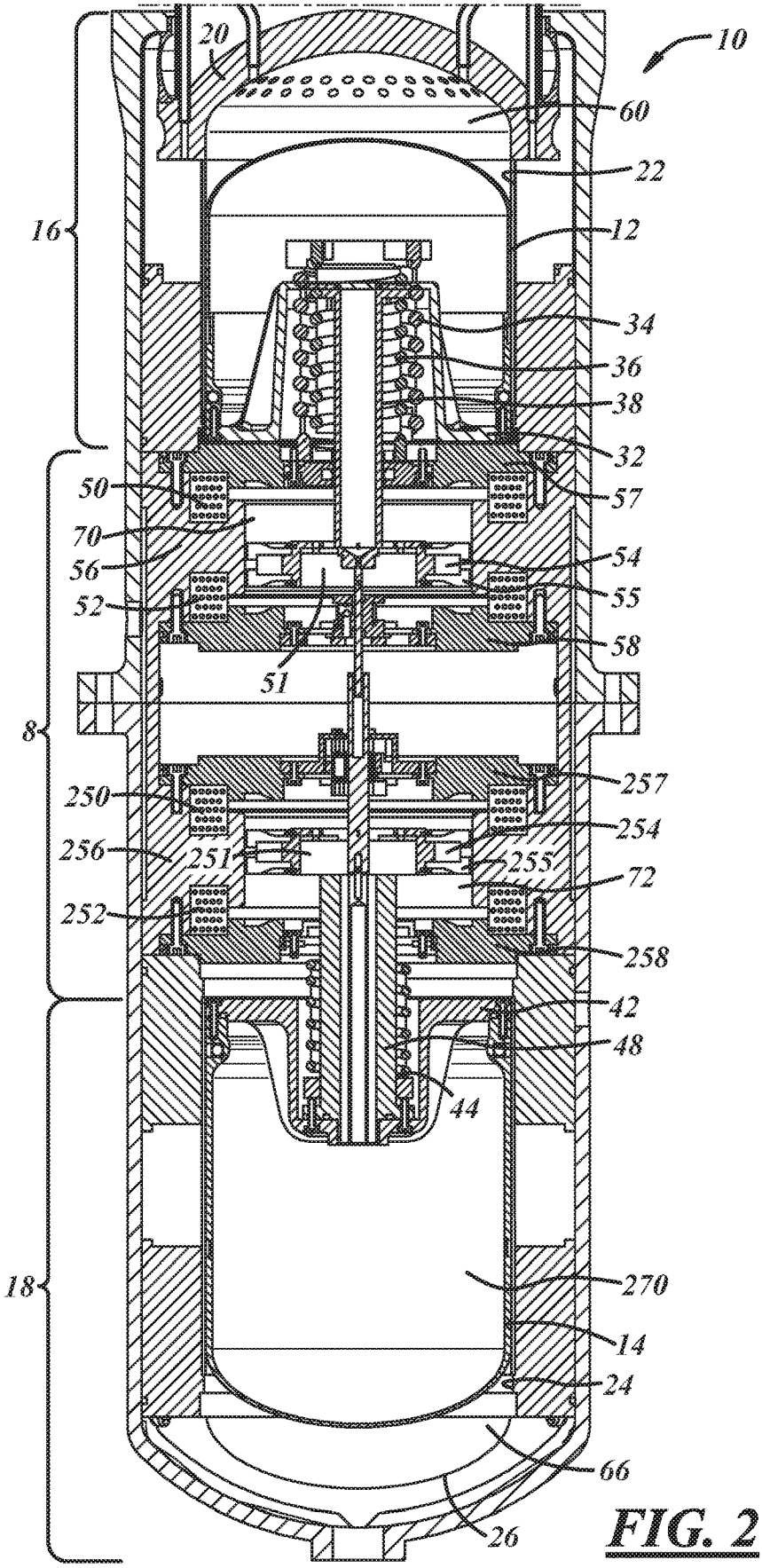
FIG. 2 is a schematic of a linear actuation system for a heat pump with the linear actuators disposed between two actuators within the heat pump.

In FIG. 2, a heat pump 10 has a hot displacer section 16 which includes a hot displacer 12 that reciprocates within a hot displacer cylinder 22. Heat pump 10 also has a cold displacer section 18 which includes a cold displacer 14 that reciprocates within a cold displacer cylinder 24. Not illustrated in FIG. 1 for the sake of clarity is a burner section or other energy input section that sits above the hot displacer section.

Hot displacer 12 is actuated by a linear actuator which includes coils 50 and 52 that are within a back iron 56. Hot displacer 12 is coupled via a shaft 38 to an armature, which includes a permanent magnet 54, pole pieces 55 that sandwich magnet 54, and a disk 51. In some alternatives, element 54 is a ferromagnetic material, one which is attracted when subjected to a magnetic field, yet largely unmagnetized when there is no such electric field. When coil 50 is energized, the armature moves upward thereby moving hot displacer 12 upwards; when coil 52 is energized, hot displacer 12 moves downwards. That actual movement is more complicated than described when element 54 is a permanent magnet because the magnet 54 is attracted when the current flow is in one direction in the coil (either 50 or 52) and is repelled when the current flow is in the opposite direction. If the energy to move hot displacer 12 between its ends of travel were supplied solely from energizing coils, the electrical energy draw would require too much electrical energy thereby seriously impairing the overall efficiency of heat pump 10. To provide much of the force to move hot displacer 12, springs 34 and 36 are disposed between hot displacer 12 and linear actuator section 8, i.e., the section of the chamber with coils and the magnets or any stationary element within heat pump 10. In the embodiment in FIG. 1, the springs are in tension when hot displacer 12 is at its upper position (farthest away from linear actuator section 8) and in compression when hot displacer 12 is at its lower position. Consequently, springs 34 and 36 bias hot displacer 12 toward a position near the middle of travel and provide much of the force for hot displacer 12 to move from end to end. Current to coils 50 and 52 are activated to draw hot displacer 12 to complete the stroke and to control the rate of approach of hot displacer 12 when approaching the end of travel.

A similar mechatronics system is provided for cold displacer 14 with coils 250 and 252 that are energized to act upon an armature that includes a permanent magnet 254 in a back iron 256. The armature (including permanent magnet 244, pole pieces 255, and disk 251) is coupled to cold displacer 14 via a shaft 48. A spring 48 is disposed between cold displacer 14 and a stationary element of heat pump 10, linear actuator section 8 of heat pump 10 in the present embodiment.

The upper linear actuator in FIG. 2 is delimited by end plates 57 and 58, which also serve as back irons. The lower linear actuator is delimited by end plates 257 and 258, which also serve as back irons. End plate 57 and end plate 258 delimit linear actuator section 8 from the rest of heat pump 10. In operation, shaft 38, along with displacer 12 and the armature coupled to shaft 38, reciprocates. An orifice is provided in end plate 57 to accommodate shaft 38; and, shaft 48 reciprocates through an orifice defined in end plate 258.

Figure 3:
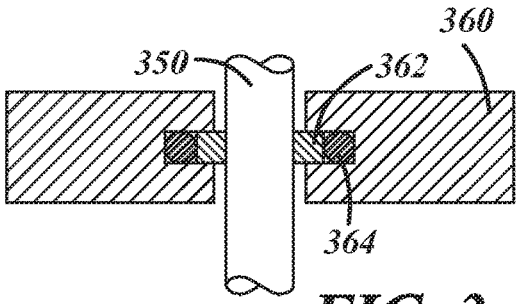
FIG. 3 is an illustration of one embodiment of a seal in an orifice in an end plate of a linear actuator section and the shaft which goes through the orifice.

One embodiment of a sealing system for a reciprocating shaft through an orifice is shown in FIG. 3. An end plate 360 has an orifice defined therein with a shaft 350 passing through the orifice. A circumferential groove around the orifice is provided to house a split ring seal 362 that has an O-ring 364 outside. In one embodiment, spring ring seal 362 is made of a metallic material and O-ring 364 is made of an elastomeric material. O-ring, pushes split ring seal 362 together so that seal 362 largely prevents flow of gases between shaft 350 and seal 362. O-ring 364 also prevents gases from short circuiting behind seals 362 and 364.

A hot chamber 60 is defined by an upper dome 20, hot displacer cylinder 22, and a top of hot displacer 12. In FIG. 2, hot displacer 12 is in its lowest position, in which there is almost no volume in a hot-warm chamber. The hot-warm chamber is defined by linear actuator section 8, a bottom of hot displacer 12 and hot displacer cylinder 22. A cold chamber 66 is defined by a lower dome 24, cold displacer cylinder 26, and a lower end of cold displacer 14. Cold displacer 14 is shown in its most upward position. Thus, a cold-warm chamber is not visible in FIG. 2. The cold-warm chamber is defined by linear actuator section 8, a top of cold displacer 14, and cold displacer cylinder 24.

In addition to the springs 34, 36, and 44, a gas spring is provided between displacers 12 and 14. Volume within the gas spring includes volumes 70 and 72 within linear actuator section 8 and an interior volume 270 within cold displacer 14. Linear actuator section 8 has gas-filled volumes 70 and 72 that move depending on where on the position of the armatures. The total volume contained within the gas spring depends on the position of hot displacer 12, at least, due to shaft 38 displacing gases when reciprocating within volume 70.

As part of the volume of the gas spring is contained within linear actuator section 8, a seal between shaft 38 reciprocating within an orifice in end plate 57 and between shaft 48 reciprocating through an end plate 258 is used to isolate the volume within the linear actuator section. One embodiment of a seal system is shown in FIG. 3. An end plate 360 has an orifice through which a shaft 350 extends. The seal system in FIG. 3 has a groove in end plate 360, proximate the orifice that accommodates shaft 350. O-ring 364 and a split ring 362 are disposed in the groove.

Figure 4:
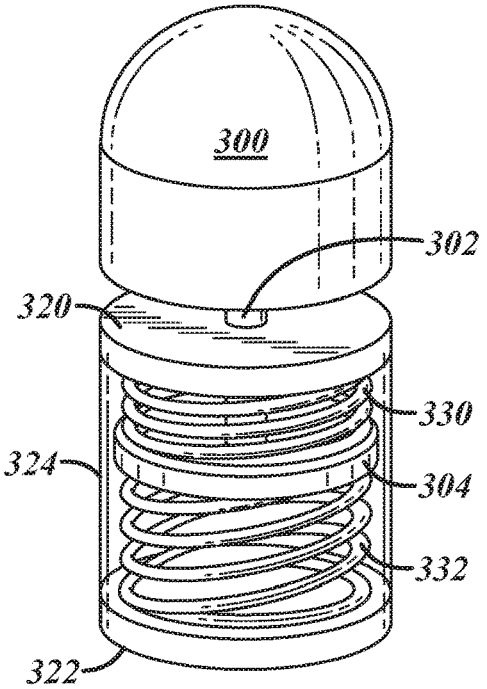
FIGS. 4 and 5 are illustrations of a displacer that is driven by two compression springs biased against each other, shown at an upper position of the displacer and a lower position of the displacer, respectively.
Figure 5:
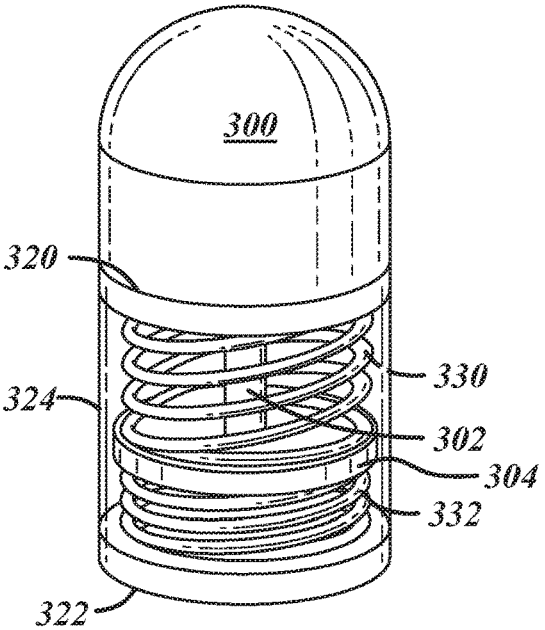

An alternative to the spring configuration shown in FIG. 2 is shown in FIGS. 4 and 5. In FIG. 4, a displacer 300 is coupled to a shaft 302 and a crosshead 304. Crosshead 304 is disposed between two stationary elements 320 and 322. Elements 320 and 322 can be held together with walls 324. Alternatively, the assembly shown in FIG. 4 is installed in a heat pump with accommodations to support stationary elements 320 and 322. Compression springs 330 and 332 are disposed between crosshead 304 and stationary element 320 and between cross head 304 and stationary element 322, respectively. In FIG. 4, displacer is at an upper position in which spring 330 is compressed. Spring 330 is pushing down on cross head 304 in such a configuration. In FIG. 5, spring 330 is less compressed, and thus pressing less on crosshead 304 compared to the configuration illustrated in FIG. 4. Spring 332, is compressed in the configuration in FIG. 5 and exerts an upward force on crosshead 304. Such pairs of compression springs could be used in place of a spring system that is in compression at one end of the displacer's travel and in tension at the other end of the displacer's travel.

Figure 6:
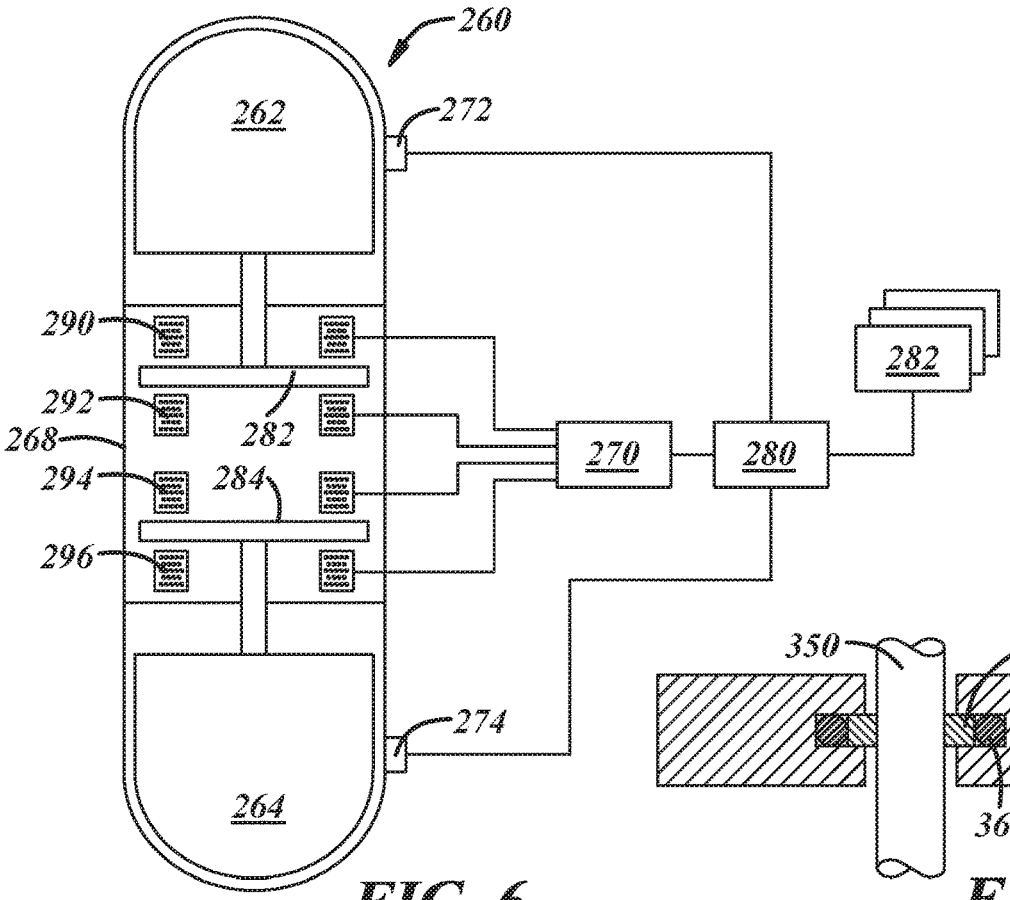
FIG. 6 is an illustration of the power and control electronics coupled to the hot and cold displacer actuators.

Current is supplied to the coils to cause them to exert a force on the armature. In the interest of clarity, the electronic and electrical hardware to do that is not illustrated in FIG. 2. It is instead shown in FIG. 6 in a simplified form. In FIG. 6, an illustration of a thermodynamic apparatus 260 (or heat pump) has a hot displacer 262 and a cold displacer 264. A linear actuator section 268 is located between displacers 260 and 262. Coils 290, 292, 294, and 296 are housed in 268. Hot displacer 262 couples to an armature 282 via a shaft; cold displacer 264 couples to an armature 284 via a shaft. A power electronics module 270 is electrically coupled to coils 290, 292, 294, and 296. Power electronics module provides the current to coils 290, 292, 294 and 296. An electronic control unit 280 electronically coupled to power electronics module 270 provides control signals to the power electronics module 270 to control the pulses of current to the coils. ECU 280 determines the desired current to send to the coils based on at least: demanded heating or cooling output from the heat pump, a signal from a position sensor 272 associated with hot displacer 262, a signal from a position sensor 274 associated with cold displacer 264, and other sensors 282, which may include sensors for determining ambient conditions such as temperature and humidity and temperature and pressure sensors within the heat pump.

Various embodiments of the present disclosure present advantages over prior art configurations of such a heat pump. One issue determined with the configuration shown in FIG. 1 is that there is conduction between the hot displacer cylinder and the cold displacer cylinder. Such conduction reduces system efficiency. The FIG. 2 configuration in which the linear actuator section separates the hot end from the cold end reduces the conduction losses.

An advantage present by the present configuration is that the hot end and cold end of the heat pump are coupled via a flange. If a fault in the hot end or the cold end is found, the functioning end can be disconnected from the end of the heat pump with a fault and the functioning end can otherwise remain assembled.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

I claim:

1. A thermodynamic apparatus, comprising:

a hot displacer disposed in a hot displacer cylinder;

a cold displacer disposed in a cold displacer cylinder, with a central axis of the cold displacer cylinder collinear with a central axis of the hot displacer cylinder;

a hot chamber defined by an upper dome, the hot displacer cylinder, and a top of the hot displacer; and a linear actuator section disposed between the hot and cold displacer cylinders wherein the linear actuator section comprising a hot displacer linear actuator and a cold displacer linear actuator.

2. The thermodynamic apparatus of claim 1 wherein the hot displacer linear actuator comprises:

a first coil disposed within the linear actuator section at a first axial location within the linear actuator section;

a second coil disposed within the linear actuator section at a second axial location within the linear actuator section; and a hot displacer armature disposed between the first coil and the second coil.

3. The thermodynamic apparatus of claim 2 wherein the cold displacer linear actuator comprises:

a third coil disposed within the linear actuator section at a third axial location within the linear actuator section;

a fourth coil disposed within the linear actuator section at a fourth axial location within the linear actuator section; and a cold displacer armature disposed between the third coil and the fourth coil the thermodynamic apparatus further comprising:

a cold displacer shaft coupled between the cold displacer armature and the cold displacer; and a hot displacer shaft coupled between the hot displacer armature and the hot displacer.

4. The thermodynamic apparatus of claim 3, further comprising:

a power electronics module coupled to the first, second, third, and fourth coils; and an electronic control unit coupled to the power electronics module.

5. The thermodynamic apparatus of claim 1 wherein a hot displacer actuator of the thermodynamic apparatus comprises:

the hot displacer linear actuator;

a shaft coupled between the armature of the hot displacer linear actuator and the hot displacer; and at least one spring disposed between the displacer and the linear actuator.

6. The thermodynamic apparatus of claim 5 wherein the at least one spring comprises one of:

a tension-compression spring that is coupled to the displacer at a first end and coupled to a stationary element of the thermodynamic apparatus at a second end; and a pair of compression springs disposed in the thermodynamic apparatus with a first of the compression springs biased to exert an upward force on the hot displacer and a second of the springs biased to exert a downward force on the hot displacer.

7. The thermodynamic apparatus of claim 6 wherein the linear actuator section has a first end plate and a second end plate; and the stationary member is the first end plate.

8. The thermodynamic apparatus of claim 1 wherein a cold displacer actuator to move the cold displacer comprises:

a cold displacer shaft coupled between the cold displacer linear actuator and the cold displacer;

a first coil disposed within the linear actuator section at a first axial location within the linear actuator section;

a second coil disposed within the linear actuator section at a second axial location within the linear actuator section;

a cold displacer armature coupled to the cold displacer shaft, the cold displacer armature disposed between the first coil and the second coil; and a spring having a first end coupled to the cold displacer and a second end coupled to a stationary member of the thermodynamic apparatus.

9. The thermodynamic apparatus of claim 1 wherein the linear actuator section has a first end plate proximate the cold displacer cylinder and a second end plate proximate the hot displacer cylinder; the thermodynamic apparatus further comprising:

a hot displacer shaft coupled to the hot displacer linear actuator;

a cold displacer shaft coupled to the cold displacer linear actuator;

a first orifice defined in the first end plate with a first seal disposed in the first orifice; and a second orifice defined in the second end plate with a second seal disposed in the second orifice wherein the hot displacer shaft passes through the first seal and the cold displacer shaft passes through the second seal.

10. The thermodynamic apparatus of claim 9 wherein a passage through the cold shaft fluidly couples a volume within the cold displacer with a volume within the linear actuator section.

11. The thermodynamic apparatus of claim 1, further comprising:

a gas spring disposed between the hot and cold displacers, the gas spring being partially comprised of gas-filled volume within the linear actuator section and volume within the cold displacer.

12. A heat pump, comprising:

a hot displacer disposed in a hot displacer cylinder;

a cold displacer disposed in a cold displacer cylinder;

a hot chamber that is delimited by a dome, the hot displacer, and the hot displacer cylinder;

a first linear actuator coupled to a shaft of the hot displacer; and a second linear actuator coupled to a shaft of the cold displacer wherein:

the first linear actuator is adjacent to the second linear actuator;

the shaft of the cold displacer extends outwardly from the first linear actuator in a first direction;

the shaft of the hot displacer extends outwardly from the second linear actuator in a second direction; and the first direction is opposed to the second direction.

13. The heat pump of claim 12 wherein:

the hot displacer is disposed proximate a first end of the heat pump;

the cold displacer is disposed proximate a second end of the heat pump;

the first and second linear actuators are disposed in a linear actuator section; and the linear actuator section is disposed between the hot and cold displacers.

14. The heat pump of claim 12 wherein each of the first and second linear actuators comprises:

first and second coils displaced along a central axis of the hot displacer cylinder from each other and disposed within a linear actuator section; and an armature comprising one of a permanent magnet and a ferromagnetic material.

15. The heat pump of claim 14, wherein:

the armature of the first linear motor is coupled to the shaft of the hot displacer; and the armature of the second linear motor is coupled to the shaft of the cold displacer.

16. The heat pump of claim 14, further comprising:

a power electronics module electrically coupled to the first and second coils of each of the first and second linear motors;

a first position sensor proximate one of: the hot displacer; the shaft associated with the hot displacer, and the armature associated with the hot displacer;

a second position sensor proximate one of: the cold displacer; the shaft associated with the cold displacer, and the armature associated with the cold displacer; and an electronics control unit electronically coupled to the first and second position sensors and to the power electronics module.

17. The heat pump of claim 12, further comprising:

a gas spring coupled between the hot displacer and the cold displacer wherein a portion of the volume comprising the gas spring is disposed within the linear motor section.

18. The heat pump of claim 12 wherein:

the shaft coupled to the hot displacer has a smaller diameter than the shaft coupled to the cold displacer; and when the displacers move, the shafts reciprocate within orifices defined in end plates of the linear motor section.

19. A heat pump, comprising:

a hot displacer disposed in a hot displacer cylinder;

a cold displacer disposed in a cold displacer cylinder, with a central axis of the cold displacer cylinder collinear with a central axis of the hot displacer cylinder;

a hot displacer linear actuator coupled to the hot displacer, the hot displacer actuator comprising a hot displacer linear motor and a hot displacer spring; and a cold displacer linear actuator coupled to the cold displacer, the cold displacer actuator comprising a cold displacer linear motor and a cold displacer spring wherein:

the hot displacer and cold displacer linear actuators are disposed in a linear actuator section; and the linear actuator section is located between the hot and cold displacer cylinders.

20. The heat pump of claim 19 wherein the linear actuator section is delimited by a cylinder, a first end plate and a second end plate; and the first and second end plates each have an orifice defined therein, the heat pump further comprising:

a first seal disposed in the orifice of the first end plate;

a second seal disposed in the orifice of the second end plate;

a hot displacer shaft coupled between the hot displacer and the hot displacer linear actuator, the hot displacer shaft passing through the first seal; and a cold displacer shaft coupled between the cold displacer and the cold displacer linear actuator, the cold displacer shaft passing through the second seal.

* * * * *